United States Patent [19]

de Buda

[11] Patent Number: 5,065,660

[45] Date of Patent: Nov. 19, 1991

[54] PIANO TUNING SYSTEM

[76] Inventor: Eric de Buda, 55 Humberview Road, Toronto, Ontario, Canada, M5S 1W7

[21] Appl. No.: 530,177

[22] Filed: May 29, 1990

[51] Int. Cl.[5] ..... G10C 3/10; G10G 7/02

[52] U.S. Cl. ..... 84/200; 84/458; 84/454; 84/455; 84/DIG. 18

[58] Field of Search ..... 84/454, 458, 200, 455, 84/DIG. 18, DIG. 27

[56] References Cited

U.S. PATENT DOCUMENTS

| | | | |
|---|---|---|---|
| 3,675,529 | 7/1972 | Van Der Woerd | 84/455 |
| 3,813,983 | 6/1974 | Paul | 84/458 |
| 4,023,462 | 5/1977 | Denov et al. | 84/454 |
| 4,077,295 | 3/1978 | Zapp | 84/304 |
| 4,088,052 | 5/1978 | Hedrick | 84/454 |
| 4,143,575 | 3/1979 | Oliver | 84/DIG. 27 X |
| 4,196,652 | 4/1980 | Raskin | 84/454 X |
| 4,297,938 | 11/1981 | Kirby | 84/455 |
| 4,327,623 | 5/1982 | Mochida et al. | 84/454 |
| 4,584,923 | 4/1986 | Minnick | 84/454 |

*Primary Examiner*—Russell E. Adams
*Assistant Examiner*—Jae N. Noh
*Attorney, Agent, or Firm*—Ridout & Maybee

[57] ABSTRACT

A system for tuning pianos and other string instruments utilizes a clamp-on probe with a feedback loop to induce a controlled vibration of the string and its natural frequency of vibration. This frequency is electronically compared to an accurate reference frequency. An associated electronic circuit controls an electric motor driven mechanism which adjusts the string tension until the correct frequency is achieved.

11 Claims, 11 Drawing Sheets

PIANO TUNING SYSTEM

This invention relates to a system for tuning pianos and other musical string instruments where accurate pitch (or frequency) is dependent on the accurate adjustment of string tension. In such instruments precise tuning is essential to producing pleasurable sounds.

Devices known as "piano tuning machines" have been previously developed, however, contrary to what their name implies, these devices are merely pitch indicators and do not actually physically tune the string. Thus they only provide the piano tuner with an indication of whether the string is sharp or flat. The piano tuner must then manually adjust the string tension to achieve the correct pitch.

Some of these devices illuminate the vibrating string with a stroboscopic light flashing at the correct frequency. When correctly tuned, the string will appear to stand still or move very slowly. Other devices have microphones and use galvanometer needles and indicator lights to indicate flat or sharp or correct pitch. The main function such devices serve is to reduce or eliminate the need for a well-trained ear, but they do not assist with the mechanical labour-intensive tasks associated with adjusting the string tension.

The idea of having the tension adjusted by a machine, instead of by hand, is not itself new. In U.S. Pat. No. 4,088,052 Hedrick proposes such a system. The idea is also presented in U.S. Pat. Nos. 4,196,652 and 4,327,623.

Normally, a piano string is made to vibrate by striking it with a felt hammer. Energy is added to the string at the moment of impact, and the string then vibrates on its own. Due to the stiffness of the string, there are harmonics with subtle frequency offsets which can make it difficult to accurately determine the prevailing pitch or frequency of the string. This problem is particularly acute for notes in the lower octaves of the piano keyboard. Mochida et al (U.S. Pat. No. 4,327,623) have attempted to address this problem with a complex signal processor which they call a "Fundamental Wave Extracting Circuit".

In the upper octaves of a piano the harmonics are not a problem, however, in these higher octaves, striking the string results in a vibration of too short a duration to permit accurate pitch adjustment. Hedrick attempts to address this problem by having his system operate in intermittent time intervals in order to give the operator a chance to repeatedly strike the same note such that the discontinuity in the vibration, caused by each impact does not interfere with the tuning control system.

Striking the string causes other problems as well. Since no energy is added to the string during the vibration, the amplitude of the string vibration diminishes with time. During this time, the actual pitch changes slightly due to non-linearities in the string which cause the natural frequency to be slightly dependent on amplitude. Also, the actual impact on the string when it is struck can cause it to shift in its mounting in such a way that its natural frequency is changed by the impact. These two factors make tuning by striking the string more difficult and limit the accuracy which can be achieved.

When tuning a piano manually, either by ear or with a pitch indicator, the piano tuner can only tune one string at a time. Since the majority of the notes in a typical piano have three strings each, the tuner must use rubber wedges called "mutes" to prevent adjacent strings from interfering. This can significantly add to the length of time required to tune a piano. A device described by Van Der Woerd in U.S. Pat. No. 3,675,529, represents an attempt to address this problem. This device incorporates a sensor into an assembly with dampers which prevents nearby strings of the same pitch from vibrating and thereby interfering with the string being tuned. The application of this device is limited because of its inability to accommodate variations in string spacing.

Furthermore, the strong static friction or "stiction" in the tuning pins, which is needed to prevent the piano strings from going out of tune prematurely, makes it difficult to adjust the string tension in a precisely controlled manner.

It is an object of the present invention to provide a piano tuning system which overcomes the above disadvantages. The problems of interfering harmonics and insufficient duration of vibration are eliminated by controlling the vibration of the string through electromagnetic forces. Thus, vibrational energy is added to the string in a controlled manner while the string is vibrating. In this way the string can be induced to vibrate at its natural fundamental frequency without the presence of interfering harmonics, and for as long as is needed to accomplish the necessary tension adjustments.

The present invention achieves this control by the use of sensors to sense the instantaneous position of the string, an electromagnet capable of transmitting controlled forces to the string, and electronic circuitry which couples the sensor and the electromagnet in a feedback loop with the correct phase angle for adding energy to the string at its natural frequency.

Another object of the present invention is to provide a self-aligning probe with a sensor and dampers in which there is allowance for variations in spacing between the strings. The present invention uses dampers not only to damp out other strings but also to gauge string spacing. A mechanical arrangement converts this measurement into a position offset which permits correct alignment between the sensor and the string being tuned.

It is yet another object of the present invention to overcome static friction or stiction in the tuning pin, by designing a large measure of stiffness into the mechanism which rotates the pin. Even with the best of design, the stiffness can never be infinite and therefore there will always be a minimum rotational speed, below which static friction will prevent smooth rotation of the pin. For this reason, it is important that the entire system be able to respond quickly to small changes in pitch.

Many schemes for pitch determination have been devised for the devices which give a visual indication of pitch. In these devices, the speed of response of the indicator is not as important due to the reaction time of the user. In an automated system, however, the speed of response of the pitch determining circuit has a profound effect on the accuracy achieved. Thus, the present invention incorporates a pitch determining circuit which possesses a high speed of response while maintaining a large measure of immunity to noise. This is achieved by measuring the phase between the signal and reference waveforms and monitoring its change.

In some pianos, particularly older ones, lack of stiffness in the pin mounting block can cause a hysteresis which cannot be eliminated by stiffness in the tension adjusting mechanism. Such hysteresis is compensated for by tuning to a slightly higher frequency so that when the torque on the tuning pin is released, the tension on the string rotates the pin until the correct frequency is achieved.

BRIEF DESCRIPTION OF THE DRAWINGS

In drawings which illustrate by way of example only a preferred embodiment of the invention.

DETAILED DESCRIPTION OF THE INVENTION

Figure 1:
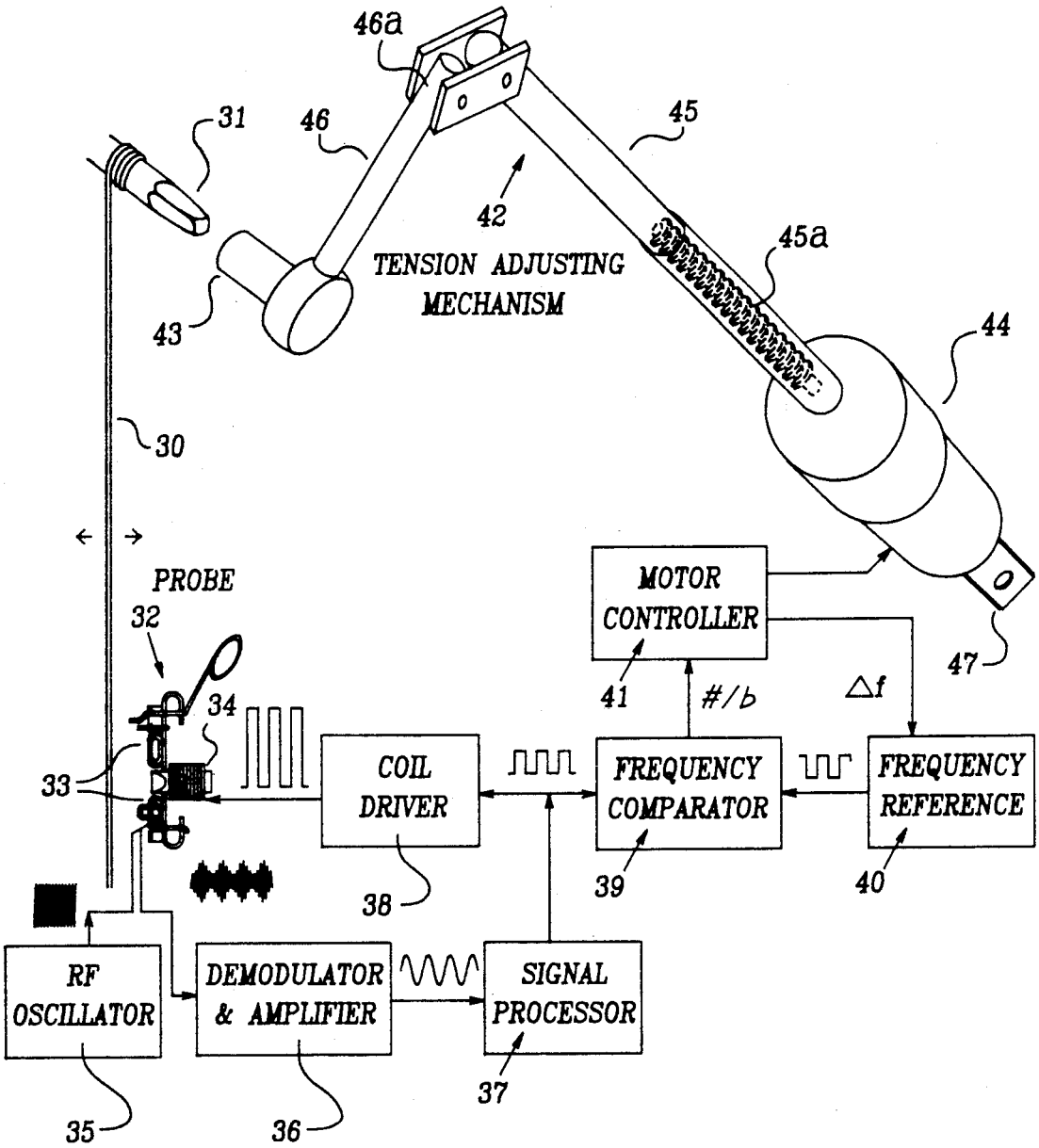
FIG. 1 is a pictorial block diagram showing the main components of the piano tuning system.
Figure 3:
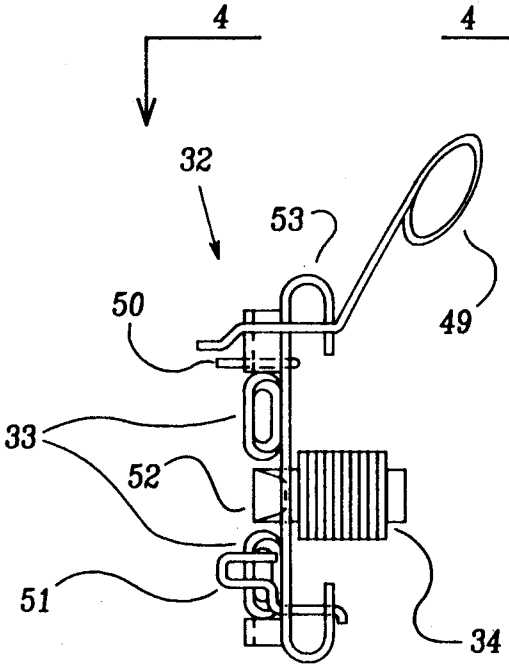
FIG. 3 is a cross-sectional view along line 3—3 of FIG. 2.
Figure 2:
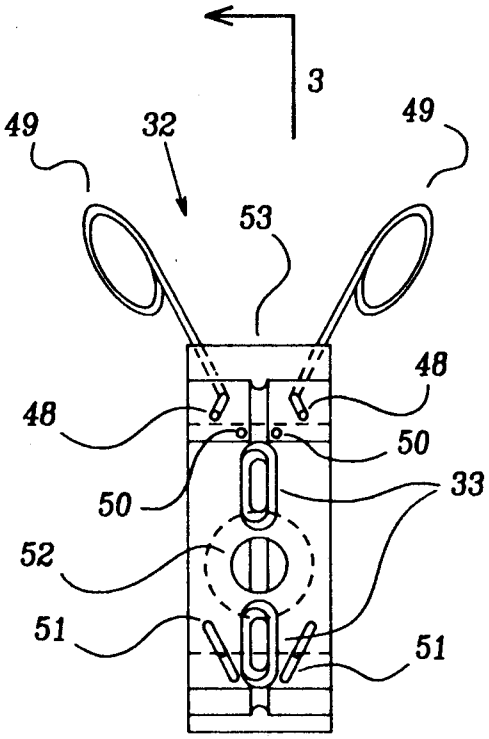
FIG. 2 is a front elevational view of the standard probe.

Referring to FIGS. 1, 2 and 3 there is shown a single piano string 30, the tension of which can be adjusted by rotating the pin 31. A probe 32, comprising a body 53, clamps 48, sensor coils 33, an electromagnet 34, retaining pins 50 and dampers 51, is clamped onto one or two adjacent strings (as in FIGS. 7, 8) such that the sensor coils 33 and the electromagnet 34 are aligned with the string 30.

As will be described in greater detail below, the RF (radio frequency) oscillator 35 provides the sensor coils with an excitation signal. The signal picked up by the sensor from the string is a low level RF carrier which is amplitude modulated at the string vibration frequency. This signal is demodulated and amplified by the demodulator and amplifier 36 to produce an audio signal. The signal processor 37 converts the signal into a square wave with a 50% duty cycle, and with the correct phase shift. The coil driver 38 amplifies the signal processor output to drive the electromagnet 34. The electromagnet 34 transmits a time varying mechanical force to the string 30, thereby closing the feedback loop and causing the string 30 to vibrate continuously at its natural frequency. The natural frequency can be either the fundamental or a harmonic depending on the amount of phase shift used, however, the fundamental is preferred.

The square wave signal from the signal processor 37 is also fed into the frequency comparator 39 which compares the frequency of said signal with the frequency of the frequency reference 40. The output of the frequency comparator 39, which indicates the frequency (or pitch) error is connected to a control input on the motor controller 41. The motor controller 41 supplies controlled electric power to the DC gear-motor 44 which in turn drives the tension adjusting mechanism 42.

In a preferred embodiment the gear-motor 44 turns a leadscrew **45*a* which is enclosed in the telescoping tuning arm 45. The tuning arm 45 applies force to the end 46*a* of the torque arm 46 causing it to apply torque to the tuning pin 31, via the mating socket 43, thereby causing the pin 31 to rotate. The reaction force is taken by the bracket 47** which is secured to any suitable immobile part on the piano frame, such as the movement mounting studs.

When the correct string frequency is reached, this is detected by the frequency comparator 39 which then signals the motor controller 41 to momentarily reverse the motor 44 to release the mechanism for removal. Preferably the socket 43 is ratchet actuated to be driven only in the clockwise direction, to tighten the pin 31. Thus momentary reversal of the socket 43 will not itself reverse the rotation of the pin 31.

If the string goes flat when the torque is released, the tuning process is repeated but the controller 41 causes the string 30 to be tightened to a slightly higher pitch before releasing the mechanism torque again. This process is repeated if necessary until the string is in tune, i.e. the natural frequency of the string equals the reference frequency.

Figure 4:
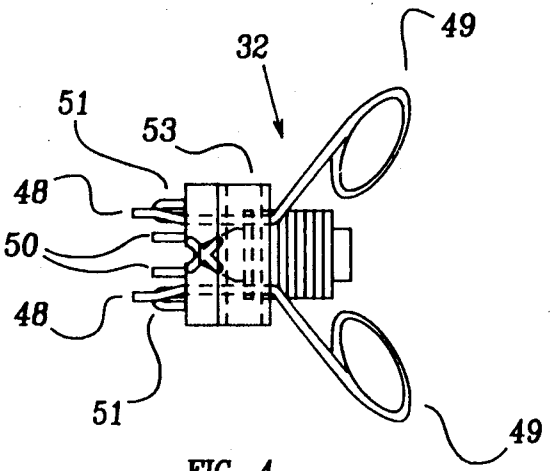
FIG. 4 is a top plan view of the probe of FIG. 2.

Referring now to FIGS. 2 to 4, in addition to the sensors 33 and electromagnet 34 whose tip is numbered 52, the probe has two clamps 48 which by manual rotation, clamp the string against two pins 50, and two dampers 51 which are pivotally mounted on the probe body 53. The clamps 48 are operated by manually applying force to handles 49. A small amount of flexibility inherent in the upper portion of the probe body 53 and the tips of the clamps 48 enables the clamps to accommodate a range of string thicknesses.

Figure 5:
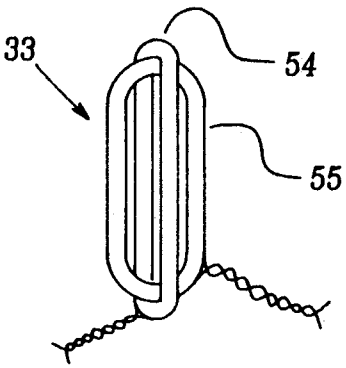
FIG. 5 shows a detail of the coil arrangement of the sensor.

Referring now to FIG. 5, each sensor 33 consists of an outer transmit coil 54 which is preferably mounted at right angles to an inner receive coil 55, so that there is no direct electromagnetic coupling between them. The presence of a metallic string, however, causes the electromagnetic field to be distorted in such a manner that some of the signal from the transmit coil 54 is picked up by the receive coil 55. The closer the string, the stronger the signal. Some interference can also be picked up from the electromagnet 34, however, this problem is minimized by using two sensors 33 mounted the same distance from the electromagnet 34, as shown in FIGS. 2 and 3, and connecting the receive coils 55 in such a manner that the interference is cancelled out. The sensor coils are preferably mounted each at a 45° angle to the probe, thus maximizing exposure to the string being tuned.

Figure 7:
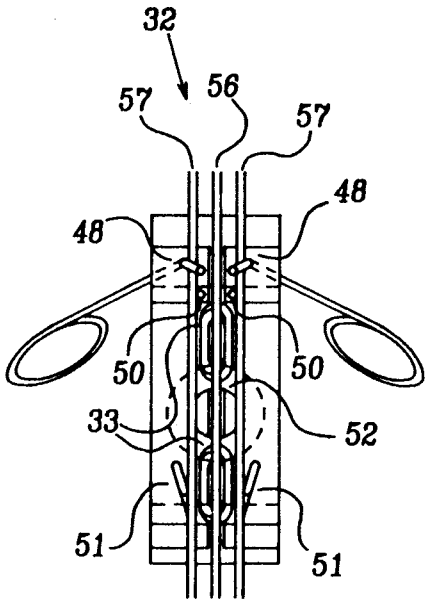
Figure 6:
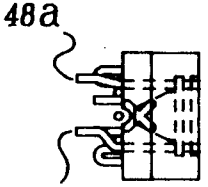

Referring now to FIG. 6, the clamps 48 are operated by rotation from the open position 48*a* to the closed position 48*b*. Referring to FIG. 7, if the middle string 56 in a group of three is to be tuned, the clamps 48 are rotated until they grip the two outer strings 57 by forcing same against the pins 50. This will have a damping effect on the outer strings 57, reinforced by resilient dampers 51 which also help to ensure that the sensors 33 and the electromagnet tip 52 are properly aligned with the string 56.

Figure 8:
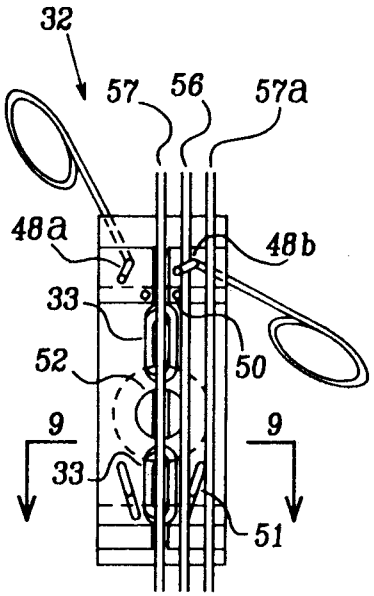
Figure 9:
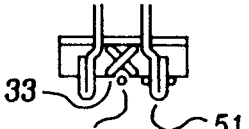
FIG. 9 is a section along line 9—9 of FIG. 8.

Referring to FIGS. 8 and 9, if an outer string 57 is to be tuned, then only one clamp 48*b* and one damper 51 is used. The clamp 48*b* is rotated until it grips the middle string 56 by forcing it against the pin 50. In such a case, the result of the forces on the string 56 between the clamp 48*b* and the pin 50 is a torque which tends to push the lower portion of the probe away from the middle string 56. The lower portion of the probe is free to move away from the middle string 56 until the damper 51 comes in contact with the other outer string 57*a*, causing it to be damped out, and also causing the sensors 33 and the electromagnet tip 52 to be correctly aligned with the string being tuned, in this case the outer string 57.

Figure 10:
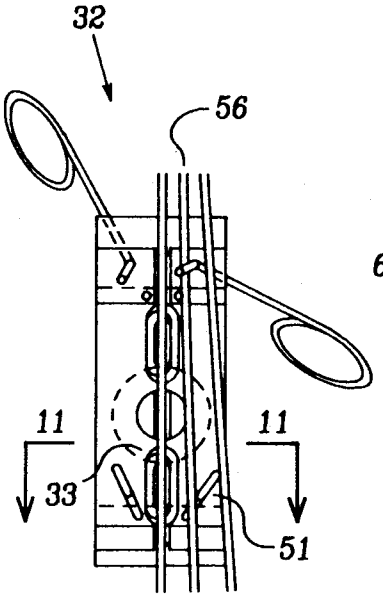
FIGS. 6, 7, 8 and 10 show the probe mounted on strings.
Figure 11:
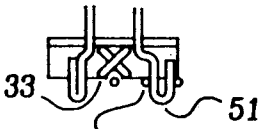
FIG. 11 is a section along line 11—11 of FIG. 10.

Referring to FIGS. 10 and 11, if the strings diverge downwardly, as is the case in many pianos, then the pivotally mounted damper 51 is rotated to a sharper horizontal angle before contacting its outer string. Thus, the lower sensor 33 will be positioned farther away from the middle string 56, so that as long as the strings are symmetrically spaced, the sensor 33 will be correctly aligned with the string being tuned.

Figure 12:
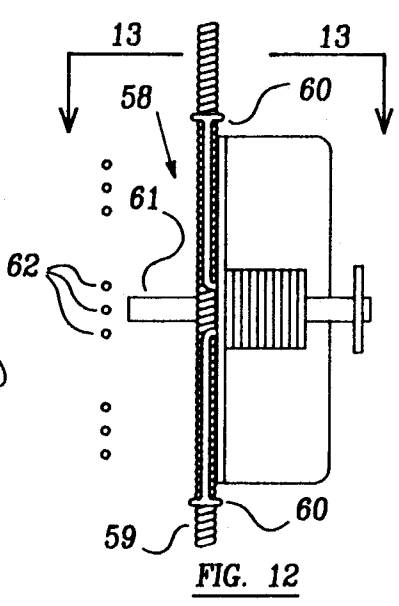
FIG. 12 is a side elevation of a further embodiment of an electromagnet.
Figure 13:
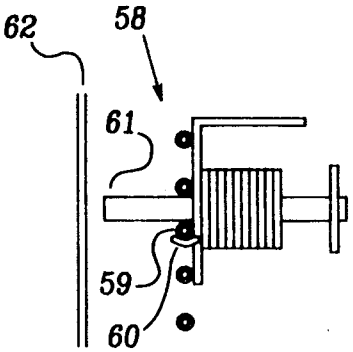
FIG. 13 is a sectional view along line 13—13 of FIG. 12.

In many upright pianos, the strings for the lower octaves form a layer which overlays some of the strings for the upper octaves. Consequently, only a short length at the end of some of the strings may be accessible to the probe 32. This presents difficulties because the vibration of a string can be difficult to control if it is induced at the end instead of the middle of the string. This problem can be eliminated by the use of a further embodiment of an electromagnet 58, illustrated in FIGS. 12 and 13. This electromagnet 58 clamps onto a lower pitched string 59 using clamps 60, and has an electromagnet tip 61 which traverses the overlaying layer of lower pitched strings, permitting access to the middle sections of the upper octave strings 62.

Figure 16:
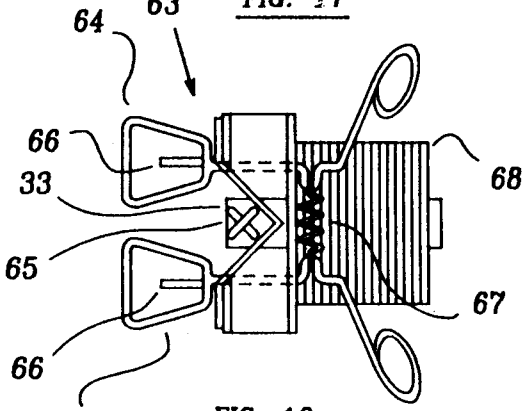
FIG. 16 is a top plan view of the probe of FIG. 14.
Figure 15:
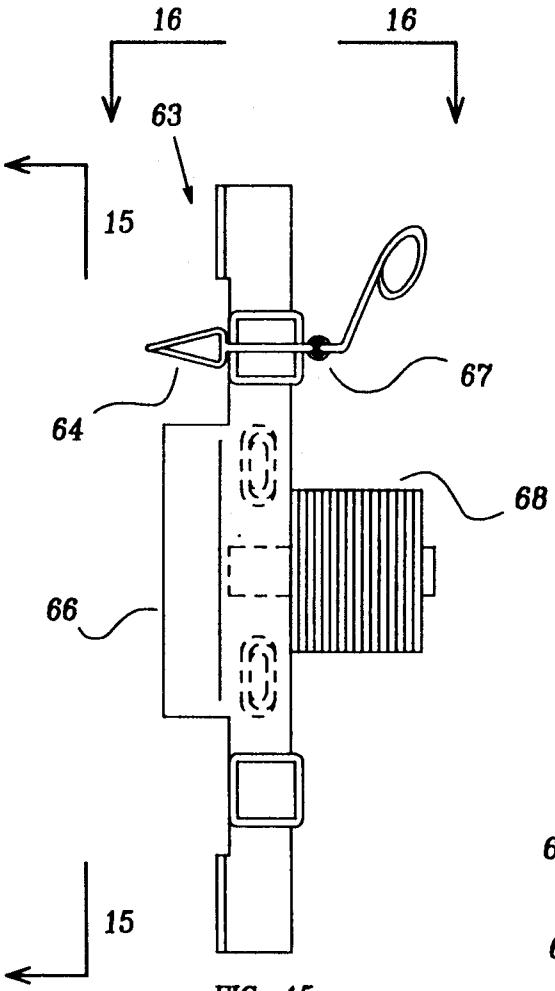
FIG. 15 is a side elevation of the probe of FIG. 14.
Figure 14:
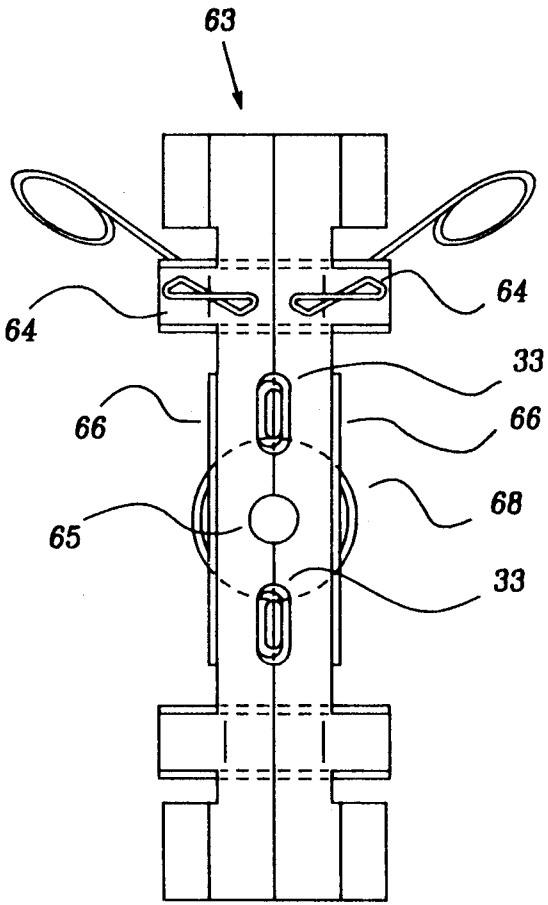
FIG. 14 is a front elevation of the preferred embodiment of a low frequency probe.

In most pianos, the strings in the lower range consist of a thin steel core onto which additional wire has been wound in the shape of a helix. The diameters of these strings can be as large as ¼ of an inch. The standard probe illustrated in FIGS. 2 to 4 could adequately sense their vibration, but would be unable to clamp onto them. FIGS. 14 to 16 illustrate a probe 63 designed for low frequency strings which can accommodate their larger diameters. The probe 63 is clamped onto adjacent strings by trapezoidal clamps 64 and the alignment of the sensors 33 and the electromagnet tip 65 is achieved by the guiding plates or ridges 66. The clamping force is supplied by the spring 67. The electromagnet coil 68 is of a larger size because of the need for increased power output, which is satisfactory due to the decreased need for frequency response.

Figure 18:
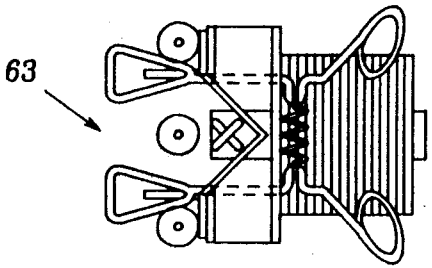
FIGS. 17 and 18 are top plan views of the probe of FIG. 14 mounted on strings.
Figure 17:
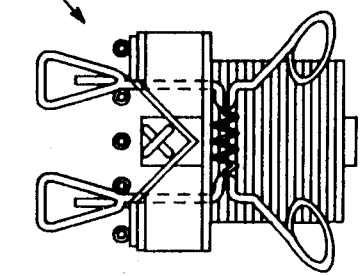

In the lower octaves string spacing varies because some lower notes have two strings each while others have only one string. The probe 63 adapts to the smaller spacing by clamping around the two strings on either side of the string being tuned, as illustrated in FIG. 17. The probe 63 adapts to the larger spacing by clamping in between the two strings on either side of said string, as illustrated in FIG. 18.

Figure 19:
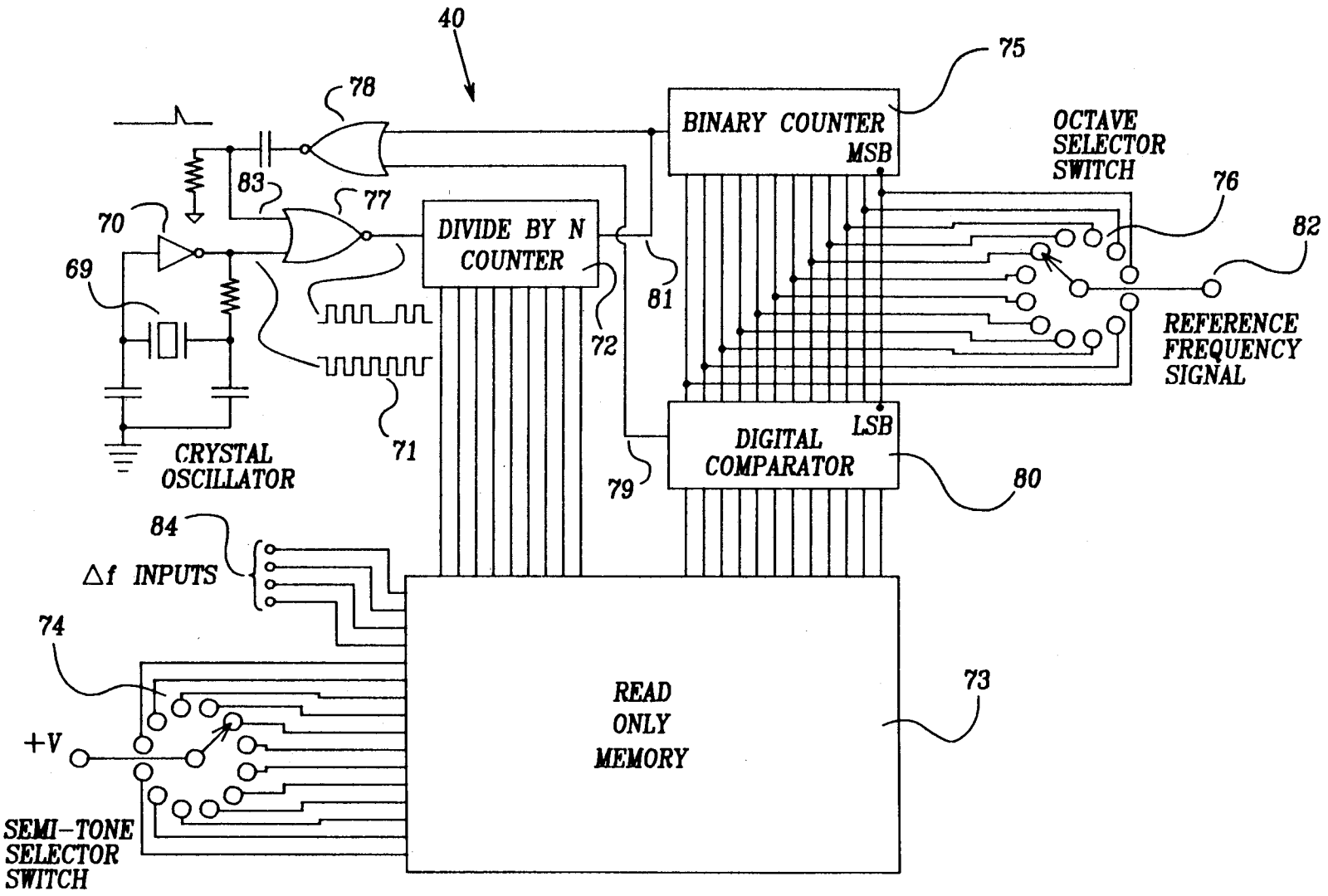
FIG. 19 is a schematic diagram of the frequency reference shown FIG. 1.

Referring now to FIG. 19, a quartz crystal 69 is made to oscillate at a known frequency by a CMOS (complementary metal oxide semiconductor) inverter 70, which produces a highly stable and accurate high frequency square wave 71. Most of the pulses in the square wave are fed into the input of the "divide by N" counter 72 which divides this frequency by the number "N" which is supplied by the read only memory 73. The number "N" supplied by the read only memory 73 depends on which semi-tone has been selected by the semi-tone selector switch 74. The output of the divide by N counter is fed into the input of a binary counter 75 which produces frequencies corresponding to the selected semi-tone in each octave. One of these frequencies is selected by the octave selector switch 76. The semi-tone selector switch 74 and the octave selector switch 76 together enable the operator to select the frequency of any note on a piano keyboard.

To improve the accuracy of the circuit, two logic NOR gates 77 and 78 are used to make the divide by N counter 72 serve as a divide by N+1 counter whenever the output 79 of the digital comparator 80 is low. In this mode, any transition from high to low on the output 81 of the divide by N counter will cause a pulse to be generated at one input 83 of the logic NOR gate 77. This causes the logic NOR gate 77 to block one pulse coming from the quartz crystal oscillator for every "N" pulses counted by the divide by N counter. Since the divide by N counter 72 only counts unblocked pulses, the oscillator must produce "N+1" pulses for every count going into the binary counter 75 as long as the output 79 of the digital comparator 80 is low. If the output is high, then no pulses are blocked and the oscillator only needs to produce "N" pulses for every pulse going into the counter 72.

Digital outputs from the read only memory 73 determine the ratio of "N" counting to "N+1" counting. This ratio remains the same regardless of the order in which outputs from the binary counter 75 are connected to inputs on the digital comparator 80, however, minimum phase error accumulation is achieved when the output 79 frequency of the digital comparator 80 is maximum. To minimize the phase error accumulation in the reference frequency signal 82, the outputs of the binary counter 75 are connected to the inputs of the digital comparator 80 in reverse order. (MSB to LSB, 2nd MSB to 2nd LSB, . . . , LSB to MSB). This results in the frequency reference being so accurate that its accuracy is limited primarily by the accuracy of the quartz crystal oscillator. If necessary, this highly accurate reference frequency signal 82 can be offset to slightly different frequency values by the "Δf" (frequency differential) inputs 84. The amount of frequency offset depends on what is programmed into the read only memory 73.

Figure 20B:
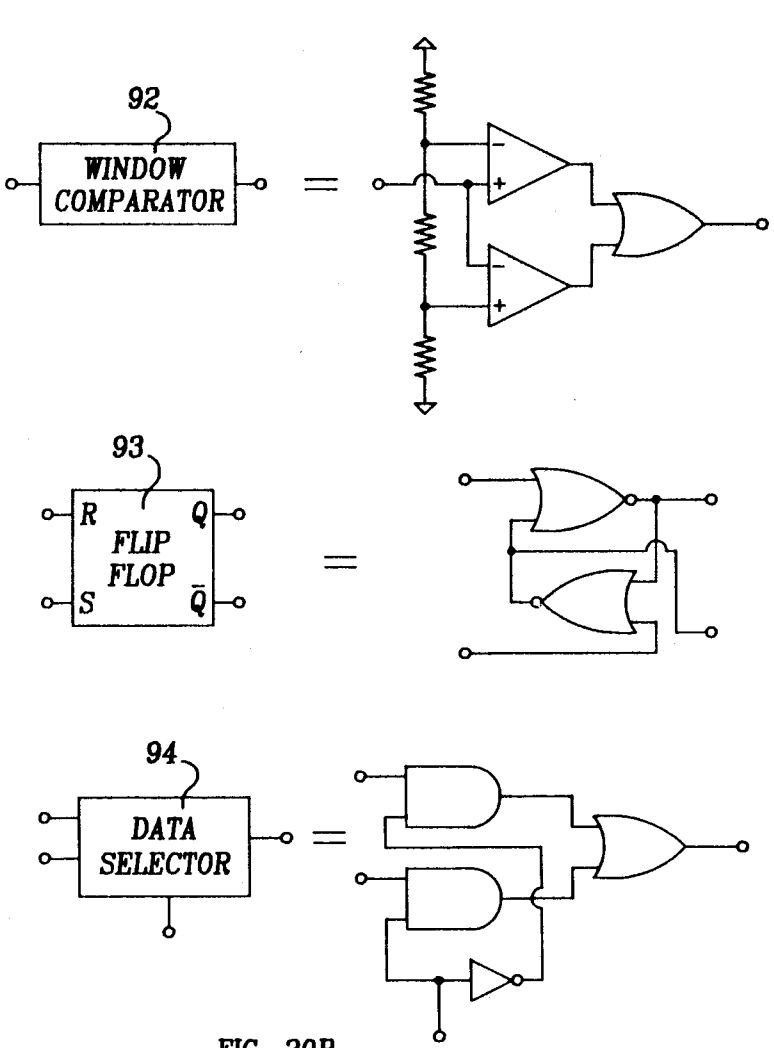
FIG. 20 is a set of electronic circuit equivalents for circuit blocks illustrated in FIGS. 21, 22, 23 and 24.
Figure 20A:
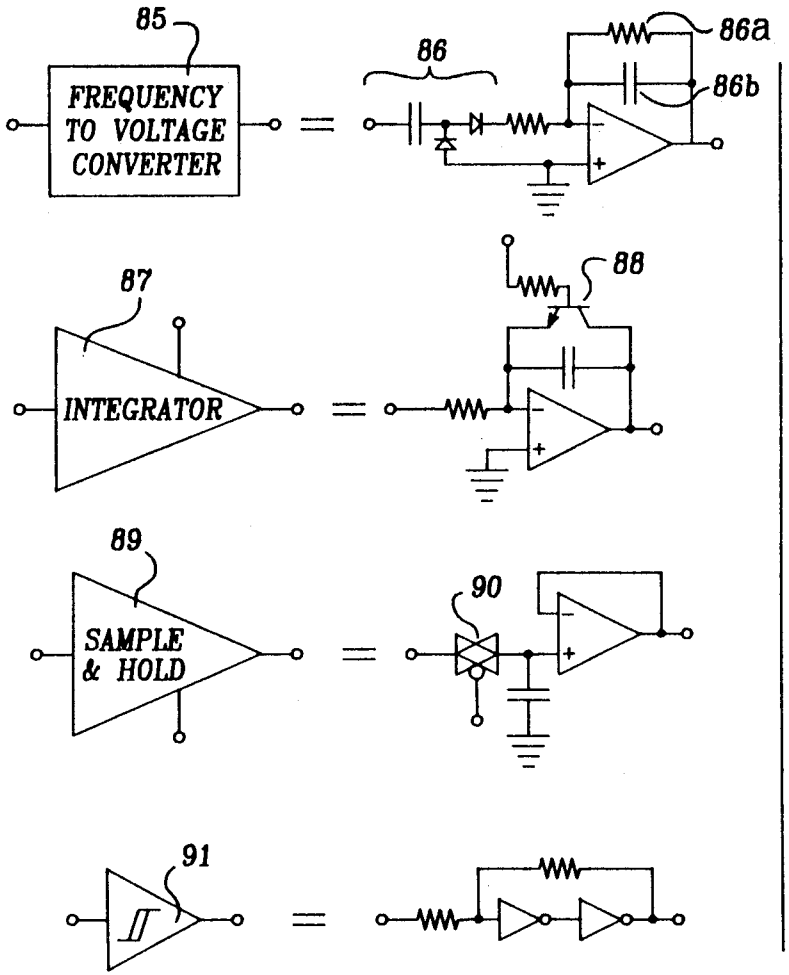

Referring to FIG. 20, a circuit equivalent is given for each of seven circuit blocks used in succeeding figures. In the frequency to voltage converter 85, the input is connected to a charge pump 86 which feeds the negative input of an operational amplifier. The output is smoothed into an analog voltage by a resistor 86*a* and capacitor 86*b* connected in feedback. As long as the input voltage is constant, the output voltage will be a negative going voltage proportional to input frequency.

The integrator 87 is a standard circuit except that a transistor 88 has been added to give it a reset input.

The sample and hold amplifier 89 uses a transmission gate 90 to sample the input. When the input to the gate 90 is high, the output voltage equals the input voltage. Otherwise, the last input voltage value is stored in the capacitor and the output remains locked to this value.

The Schmitt trigger 91 is a standard circuit, and will be well known to those skilled in the art.

The window comparator 92 combines two comparators with a resistive divider and a logic OR gate so that the output goes high whenever the input voltage value is outside a voltage range which is defined by the resistive divider.

Flip-flop 93 is a standard circuit and will be well known to those skilled in the art.

The data selector 94 uses logic gates to select one of two data inputs, depending upon whether the control input is high or low. If said control input is low, then the upper data input is selected. If said input is high, then the lower data input is selected. The logic level of the selected data input is transferred to the output.

Figure 21:
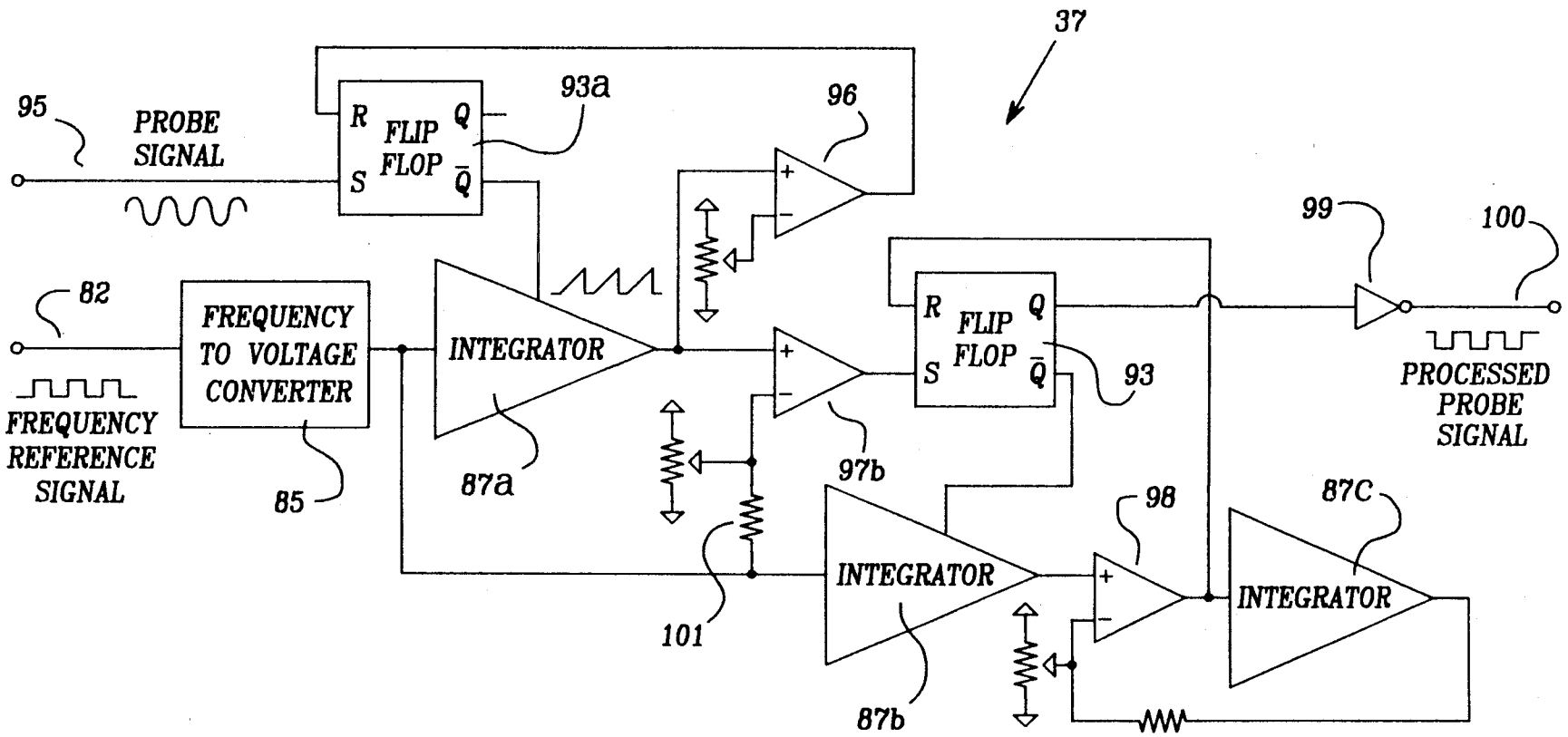
FIG. 21 is a schematic diagram of the signal processor shown in FIG. 1.

A preferred embodiment of signal processor 37 is illustrated in FIG. 21. The frequency to voltage converter 85 converts the reference frequency signal 82 into an analog voltage which controls the speed of the integrators 87*a* and 87*b* to match the frequency of the reference frequency signal 82. The demodulated and amplified probe signal 95 is fed into the "S" input of the flip-flop 93*a*. At each positive zero crossing of this signal, the "Q-bar" signal goes low and the integrator 87*a* starts. The voltage output of the integrator 87*a* rises until the comparator 96 resets flip-flop 93*a*, causing the integrator 87*a* to be reset. The resulting wave form is a sawtooth wave with spaces between the teeth. These spaces allow for frequency differences between the probe signal 95 and the reference frequency signal 82. This sawtooth wave is fed into comparator 97 which sets flip-flop 93*b* when the voltage of the sawtooth exceeds a certain level, causing integrator 87*b* to start approximately 90° after each positive zero crossing of probe signal 95. The comparator 98 resets flip-flop 93*b* after an additional 180°. The integrator 87*c* adjusts the threshold of the comparator 98 to maintain a 50% output duty cycle in spite of any circuit inaccuracies which may exist. The "Q" output of flip-flop 93*b* is therefore a squared version of the probe signal 95 but delayed by approximately 90°. This "Q" output is inverted by the inverter 99 to produce the processed probe signal 100 which is advanced by approximately 90° ahead of the probe signal 95. The resistor 101 is used to further advance the phase of the processed probe signal 95 at higher frequencies in order to compensate for phase delays in the probe.

Figure 22:
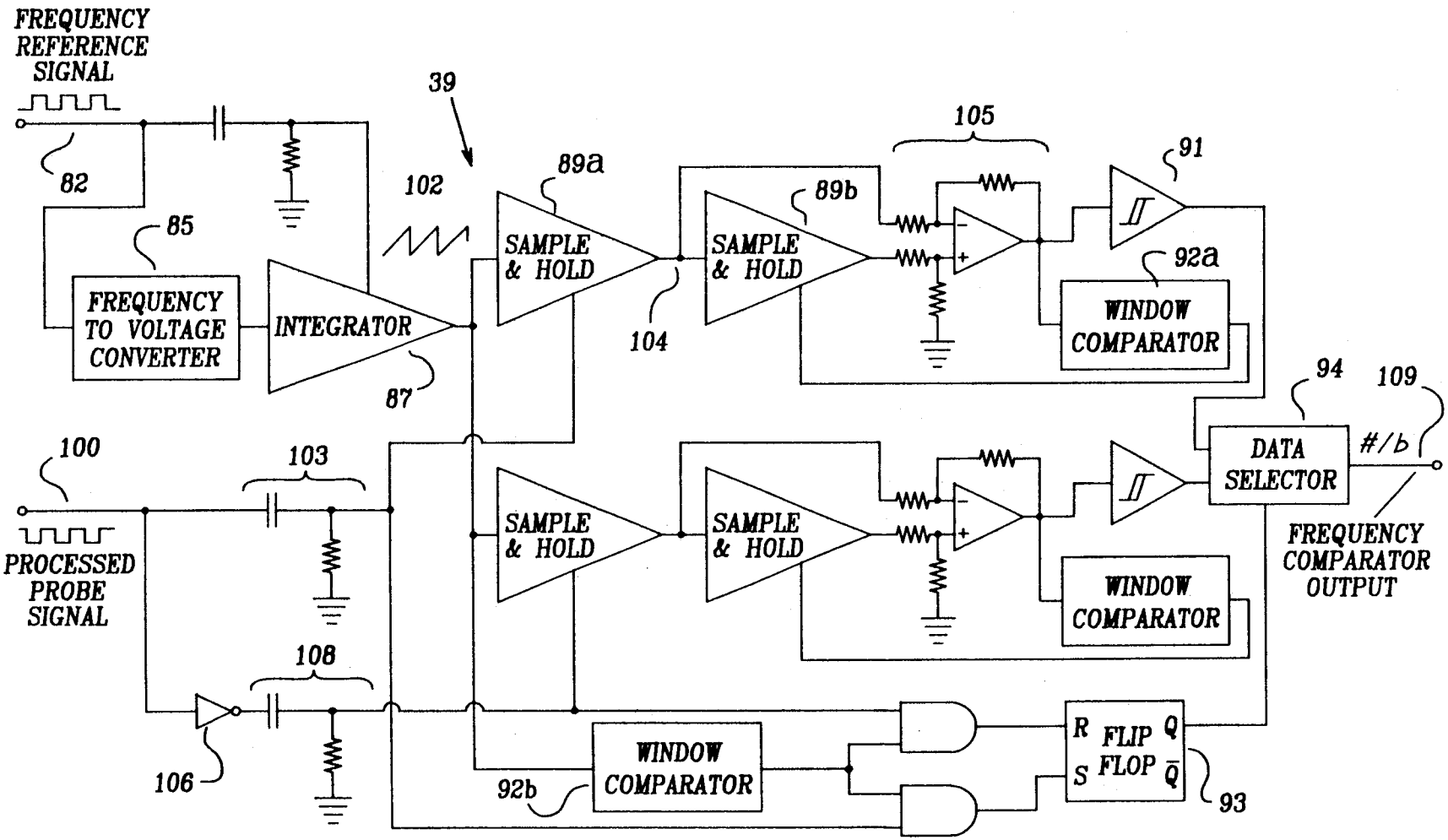
FIG. 22 is a schematic diagram of the frequency comparator shown in FIG. 1.

A preferred embodiment of the frequency comparator is illustrated in FIG. 22. A frequency to voltage converter 85 is coupled to an integrator 87 with its reset input activated with each rising edge on the reference frequency signal 82. The output 102 of the integrator 87 is a sawtooth wave of a constant amplitude having the same frequency as the frequency reference signal 82. The RC network 103 causes any positive transition on the processed probe signal 100 to in turn cause the sample and hold amplifier 89*a* to sample the waveform 102 such that the output 104 of the amplifier 89*a* is a voltage proportional to the phase difference between the reference frequency signal 82 and the processed probe signal 100. This output 104 is fed into a second sample and hold amplifier 89*b*, the output and input of which are connected to a differential amplifier 105. The amplifier 105 amplifies the voltage difference between said input and output. If the voltage difference is greater than a preset value, then the amplifier 105 first triggers the Schmitt trigger 91 and then triggers the window comparator 92*a*. The window comparator 92*a* then causes the sample and hold amplifier 89*b* to set its output equal to its input, causing the output of the differential amplifier 105 to return to its midpoint.

If the phase signal 104 changes again, by a sufficient amount, this process is repeated. The output of the Schmitt trigger 91 indicates the direction of the phase change and therefore indicates whether the processed probe signal 100 frequency is higher or lower than the frequency of the reference frequency signal 82, with the exception that this part of the circuit becomes momentarily unstable when the sample and hold amplifier 89*a* tries to sample the falling edge of the sawtooth wave 102. This problem is eliminated by having a second identical circuit portion which operates 180° out of phase of the first circuit portion, using the inverted signal output of the inverter 106. While one circuit portion is unstable, the other can be selected to give the required indication. If the voltage on the signal 102 is close to a falling edge (either side), the window comparator 92*b* activates the logic AND gates 107. Any pulses coming from the RC networks 103 and 108 will then trigger flip-flop 93, causing the data selector to select the circuit portion opposite to the one which produced the pulse. In this way, the data selector 94 selects the signal from the stable circuit portion so that its output, and also the frequency comparator output 109 gives a true indication at all times as to whether the processed probe signal 100 frequency is high or low (sharp or flat, #/b). The voltage window of the window comparator 92*a* has the effect of giving the circuit a phase deadband or hysteresis which makes it less sensitive to noise. Having the deadband with respect to phase instead of frequency offset is advantageous. Firstly, a phase deadband does not put a limit on the smallest frequency difference that can be detected, but only increases the length of time required to detect it in inverse proportion to the amount of the differential. Secondly, the length of time required for detection is smaller for larger frequency differences for which a high speed of response is more important, so that both high accuracy and a high speed of response are maintained as needed.

Figure 23:
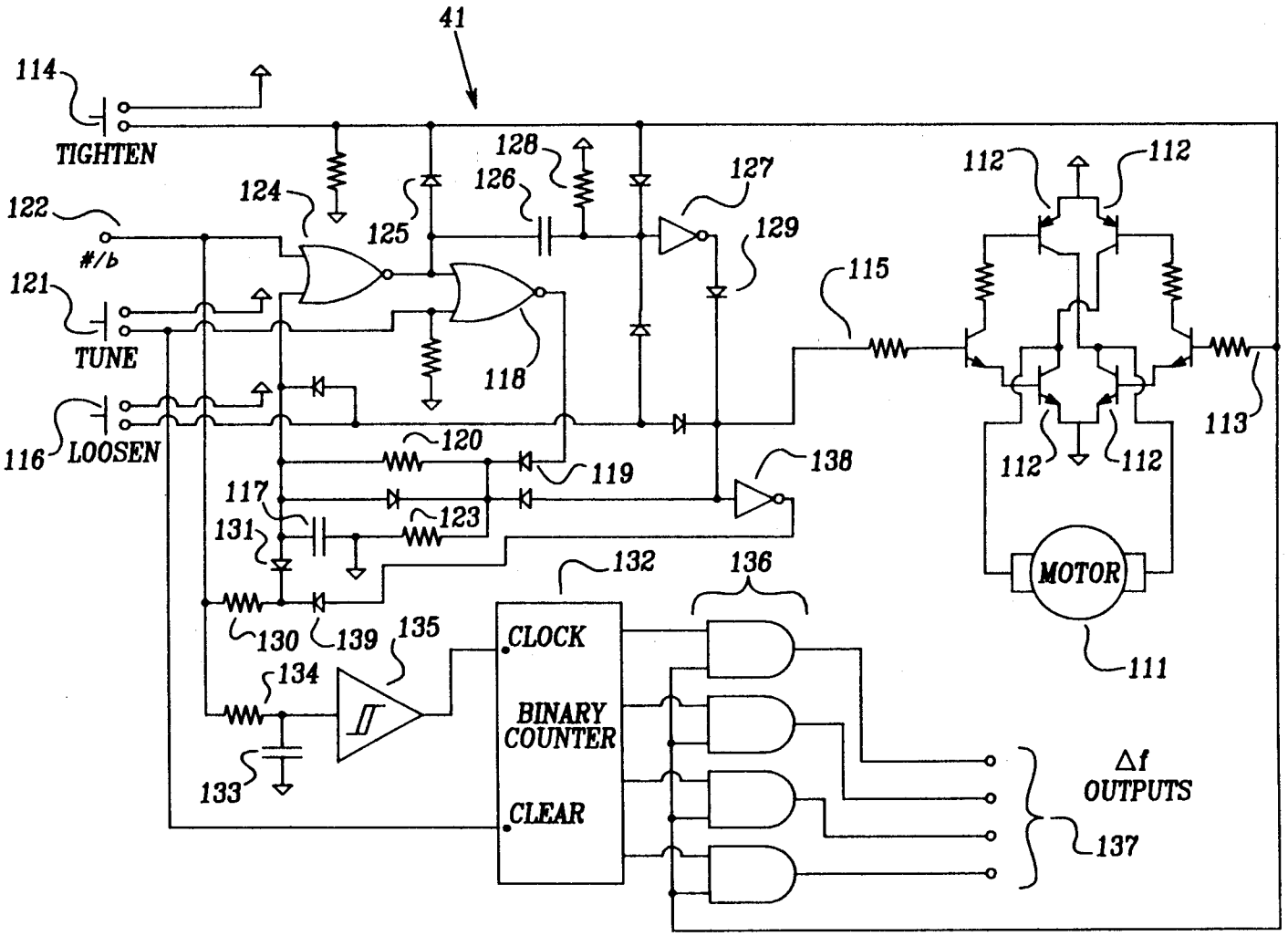
FIG. 23 is a schematic diagram of the motor controller shown in FIG. 1.

A preferred embodiment of the motor controller is illustrated in FIG. 23. Power to the motor 111 is controlled by a bridge arrangement of power transistors 112. If the right input 113 goes high, which happens if the "tighten" switch 114 is closed momentarily, the motor 111 is made to rotate clockwise (forward). If the left input 115 goes high, which happens if the "loosen" switch 116 is closed momentarily, the motor 111 is made to rotate counterclockwise (reverse). Initially, before the circuit is activated, a charge is maintained on the capacitor 117 by the output of the logic NOR gate 118 via a diode 119, and a resistor 120. If the "tune" switch 121 is closed while the #/b (sharp/flat) input 122 (connected to the frequency comparator output 109, FIG. 22) is low (indicating flat), it causes the output of the logic NOR gate 118 to go low, and the capacitor 117 is allowed to discharge through the resistors 120 and 123. This causes the other input of the logic NOR gate 124 to go low causing the output of gate 124 to go high thereby enabling the tuning cycle to continue after the "tune" switch is no longer closed. The diode 125 conducts this signal to the right input 113 of the power bridge causing the motor 111 to rotate in the forward direction. If the #/b (sharp/flat) input 122 goes high momentarily due to a noise spike, the output of the logic NOR gate 124 will immediately go low, causing the motor to decelerate. The output of the logic NOR gate 118 will also go high momentarily, and the capacitor 117 will start to charge via the diode 119 and the resistor 120. However, the noise spike will not last long enough to charge the capacitor 117, so that when the #/b (sharp/flat) input 122 goes low again, the output of the logic NOR gate 124 will again go high, and the motor will continue rotating forward and tightening the string. If the #/b (sharp/flat) input 122 goes high and stays high, then the output of the logic NOR gate 124 goes low and the motor 111 stops rotating. The capacitor 126 causes the input of the inverter 127 to go low and stay low momentarily as determined by the resistor 128. The diode 129 conducts the output of said inverter to the left input of the power bridge, causing the motor 111 to reverse momentarily. This releases the torque and allows the tension adjusting mechanism to be moved to another tuning pin.

If the note goes flat again while the torque is being released (due to hysteresis), then the resistor 130 and the diode 131 will cause the capacitor 117 to be discharged, thereby causing the tuning cycle to repeat itself with the exception that the binary counter 132 has been advanced to the next Δf value. The binary counter 132 is set to zero by the "clear" input whenever the "tune" switch 121 is closed. It advances to the next value when the #/b (sharp/flat) input 122 goes high and stays high long enough to charge the capacitor 133 through the resistor 134. This prevents the counter from being triggered by noise.

The Schmitt trigger 135 ensures that the counter will get a proper rising edge. The logic AND gates 136 activate the Δf outputs 137 while the string is being tightened and deactivate them while the torque is being released. If the #/b (sharp/flat) input 122 stays high for the duration determined by the capacitor 126 and the resistor 128, then after the output of the inverter 127 goes low, the output of the inverter 138 goes high, and through the diode 139 prevents the capacitor 117 from being discharged through the diode 131. The motor then stops turning.

The sequence of operation is as follows: With the bracket 47 of the tuning arm 45 secured to the piano frame, the operator secures the socket 43 over the tuning pin of the string to be tuned and places the probe 32, or 63, as previously described, over the string to be tuned. The operator must ensure that the frequency selected by the combination of the octave and semi-tone selector switches corresponds to the frequency of the string being tuned. The momentary "tune" switch 121 is closed, the binary counter resets to zero, and the motor turns in the forward direction to tighten the string until the #/b (sharp/flat) input goes high. If said input goes high only momentarily due to a noise spike the motor momentarily decelerates, but otherwise the noise spike is ignored. If said input goes high for a longer duration, the binary counter is advanced and the motor is put in reverse. If said input goes low while the torque is being released (motor in reverse), then the tuning cycle resumes with the binary counter taking the next larger count. Tuning stops if the #/b (sharp/flat) signal 122 stays high for the full duration of the motor reverse motion. If desired, the frequency modifying anti-hysteresis feature can be disabled by disconnecting the diode 131, in which case the controller will do one forward/reverse cycle in which the forward motion is terminated by a low to high transition on the #/b input. The operator then selects the pitch of the next string to be tuned, moves the socket 43 and probe 32, or 63 to the next string, and repeats the operation.

Figure 26:
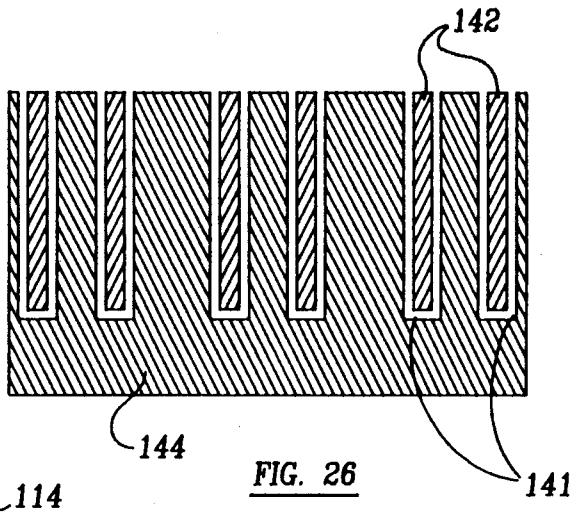
FIG. 26 is a section along line 26—26 of FIG. 25.
Figure 25:
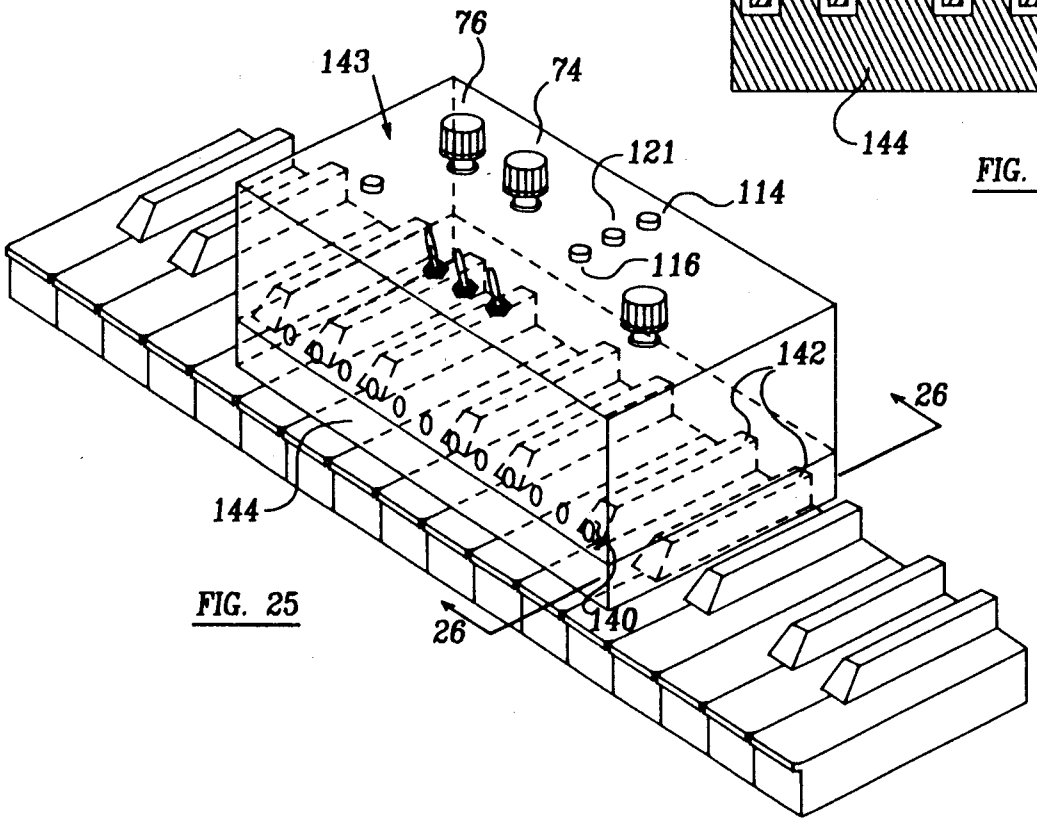
FIG. 25 shows the controller on a piano keyboard.

Referring now to FIGS. 25 and 26, one of the difficulties an operator may experience, if the piano is very badly out of tune, is uncertainty about whether the controller 143 is set to the correct note. This problem is addressed by having twelve indicator lights 140 on the controller, one for each semi-tone of an octave, positioned above their respective keys on the keyboard. The bottom surface 144 of the controller 143 itself may be provided with slots 141 cut into it of a size and spacing to match the black keys 142 on the piano keyboard. During the tuning session, the controller 143 rests on top of the piano keyboard and the slot pattern in the bottom of the controller 143 ensures that for each octave, the controller 143 can be located on the keyboard in only one position, being the position in which the semi-tone indicator lights are individually positioned directly above or adjacent to their corresponding keys (on the keyboard). This also ensures that on any piano, regardless of its design, there will always be a convenient place to rest the controller during the tuning operation.

Some alternative embodiments of the present invention will now be briefly described. Instead of using electromagnetic RF coils, one could use a single passive coil which responds to the changes in the magnetic field which occur when the string vibrates near a permanent magnet or other source of magnetic flux. Instead of using a coil, one could use a Hall effect sensor. Another option would be to make the electromagnet itself into a sensor since the string vibration induces a voltage on its terminals. Some means would be required to separate this signal from the excitation voltage. Instead of using electromagnetic methods, one could use electrostatics. The string could be charged with a DC voltage so that its vibration induces a voltage in a nearby conductive surface. An optical detector such as a photodiode or phototransistor can also pick up vibration if the string surface is illuminated by optical radiation. A laser diode of the type used in compact disc players could provide illumination for very sensitive vibration sensing provided that it is well focused. Focusing and positioning could be achieved using the same moving coil arrangement found in these disc players. Finally, a microphone can be used, however, it must have the required frequency response and must be properly positioned.

An alternative to the clamp and damper arrangement, would be to replace the clamps with dampers so that the probe has four dampers. The dampers could be spring loaded and have notches to help them maintain their grip on the strings.

A probe with one side missing, could be useful for reaching strings in hard-to-get-to places such as next to a support beam.

It may also be possible to fit the probe onto an automated device which, by sequentially gripping the strings, is able to automatically index the probe from one string to the next. Indexing could also be done relative to a temporarily mounted track. An alternative to this would be to construct a multi-element array of sensors and electromagnets, one for each string. Damping of adjacent strings could be accomplished electronically, by feeding the electromagnets signals which are the exact opposite phase of the signals that would be required to build up the vibration. Damping could also be accomplished by the use of solenoid actuated dampers.

Figure 24:
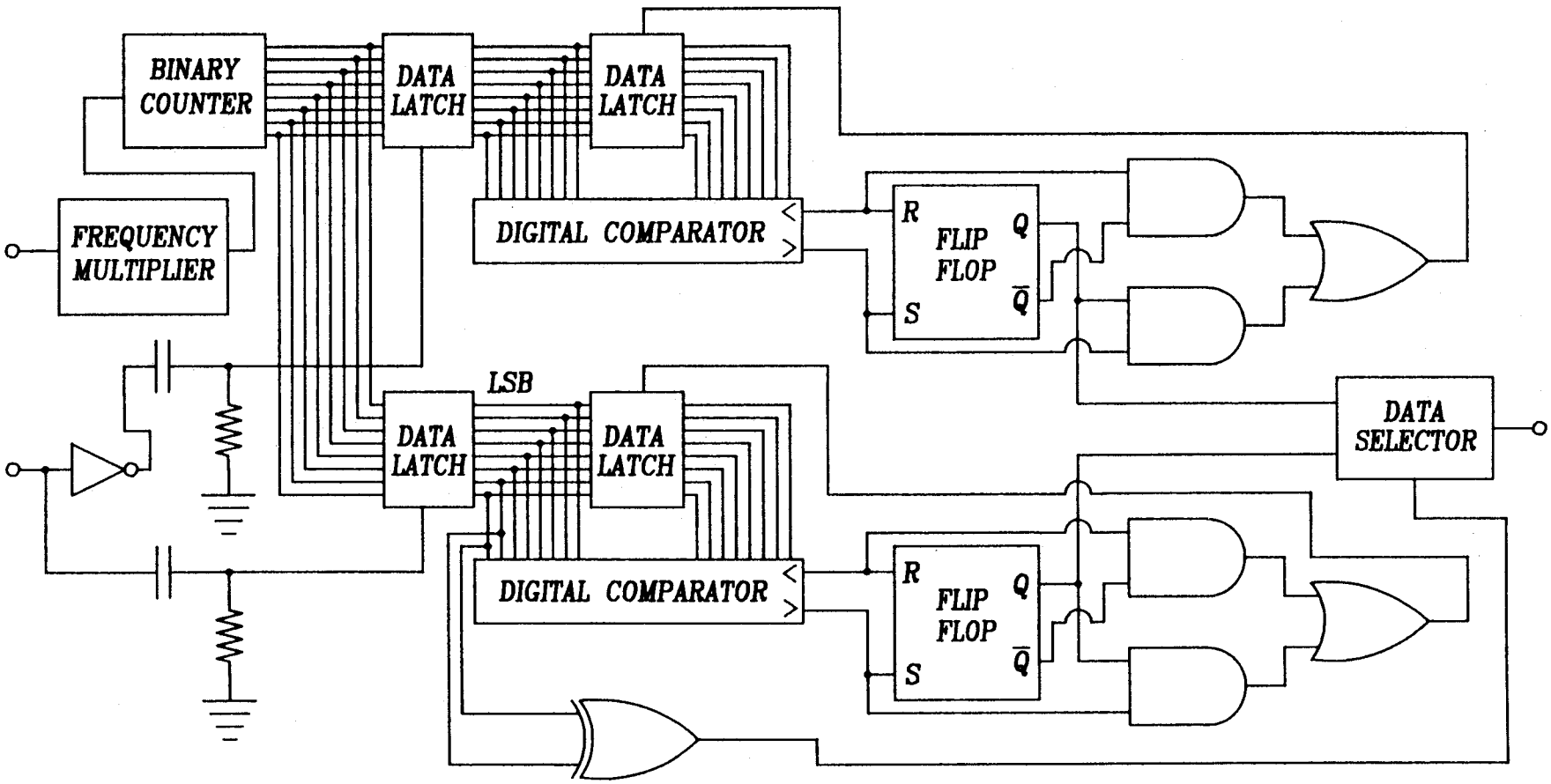
FIG. 24 is an alternative embodiment of the frequency comparator illustrated in FIG. 22.

Many of the analog circuit functions could be achieved with digital circuitry. For the phase shifting circuit in the signal processor, an oscillator and a counter could be used to generate a time delay according to information stored in read only memory. Another approach would be to use a phase-lock loop. The frequency comparator can be made to work with digital circuitry as shown in FIG. 24. Instead of a sawtooth wave, the digital equivalent is used, this being the output of a binary counter. Data latches can then be used instead of sample and hold circuits, while the basic functional principle remains the same. If the analog version is used, however, a simple way to achieve the Δf offsets is to feed controlled currents into the capacitors of the second stage sample and hold amplifiers.

There are different strategies that can be used when offsetting the reference frequency in order to compensate for hysteresis. Before each successive tuning cycle, the reference frequency can be increased by the same percentage increment. Alternatively, the amount by which the note goes flat due to hysteresis can be measured, and this value used to determine the next frequency offset.

Another way to address the problem of hysteresis is to use impact torque for adjusting the tension. A smaller amount of impact torque could be added to static torque in order to reduce the shock waves in the piano frame that impact torque tends to produce.

In the described embodiment, there are no warning signals given to the operator who is therefore required to maintain a certain level of alertness. A warning could be added to warn the operator if changing the tension doesn't change the natural frequency. This could be coupled to an automatic shutdown circuit if the operator doesn't respond. This could address the problem which can arise if the operator inadvertently puts the tension adjusting mechanism onto a pin which does not correspond to the string which has the probe. Other warnings for problems such as excessive torque could also be added.

Another approach to handling the analog and the digital circuit functions is to use a microcomputer, and program in the functions with software, in a manner which will be obvious to someone skilled in the art.

An alternative to inducing vibration at the natural frequency of the string and comparing this to a reference frequency, is to induce vibration at the desired frequency and compare the phase shift of the response to what it should be if the string is in tune. In this case, the frequency error of the controlled vibration would be zero, regardless of the natural frequency error of the string, the natural frequency error being the difference between the desired natural frequency, and the natural frequency at which the string would vibrate if it was vibrating on its own. Therefore, the natural frequency error is not measured directly in this case, but is instead determined using information derived from the phase shift signal. The advantage of this approach is that the electronic circuitry can be greatly simplified. The signal processor is no longer needed as the signal from the frequency reference can be fed directly into the electromagnet coil driver. The frequency comparator is also no longer needed and can be replaced with a simple circuit for measuring phase and comparing it to the desired value. This could for example be in the form of a timing circuit which measures the time interval between the positive zero crossings of the electromagnet coil driver input signal and the demodulated sensor output signal, and compares this value to a normal value stored in read only memory. If the string is flat, then the phase of the demodulated sensor signal will lag behind the normal value, while if it is sharp, it will lead or be ahead of the normal value. In this way, the timing circuit can have a sharp/flat output equivalent to that of the frequency comparator which it replaces. One disadvantage is that it is not as accurate, and while this could be addressed by a means of averaging over a number of cycles, such a solution would tend to detract from the simplicity of this approach. Another disadvantage is that in its simplest form, it would not work very well on pianos (or other string instruments) which are very badly out of tune, because the string will only respond to vibrational energy close to or at its natural frequency (or frequencies). This problem could be addressed by offsetting the reference frequency (e.g. with Δf inputs) initially and then moving it closer to the correct frequency as the natural frequency of the string approaches the correct value. The reference frequency could then be set to the correct value (or some other chosen value) once the natural frequency is within range. Implementing this kind of solution would also tend to detract from the simplicity of this approach.

The described embodiment does not have a provision for loosening the strings if they are sharp, as this simplifies the design of the tension adjusting mechanism, however, this feature could be added.

At the sacrifice of some portability, the electric gear motor could be replaced with a high speed direct drive electric motor. This would require a much larger power supply, but would speed up the tuning process. A provision would also be needed for slowing the motor down as the frequency approaches the correct value in order to prevent overshoot.

Finally, a robotic system could be used to sequentially position the tension adjusting mechanism onto all of the tuning pins so that an operator is not needed while the tuning is in progress. This when combined with the previously mentioned multi-element array, or probe indexing, and with electronic or other means of damping, could provide an automatic tuning system that is well suited to a production environment. Such a robotic system could also be part of a module containing the above, and which mounts into the piano (or other instrument) in place of the movement. Such a module could be made portable, however, the greatest portability would be achieved by the embodiment described in detail above.

I claim:

1. A system for tuning piano strings, comprising:

means for inducing a controlled vibration in the string at its natural frequency, comprising a sensor for sensing the string vibration, an actuator for transmitting controlled time-varying forces to the string, and a feedback loop comprising a signal processor modifying the phase of the signal from the sensor, feeding the actuator with processed signals from the sensor having the correct phase shift such that the string is caused to vibrate at its natural frequency;

means for sensing the frequency of the vibration;

means for comparing the vibration frequency against a reference frequency representing a desired frequency of vibration for the string;

means for determining the frequency error of the vibration frequency relative to the reference frequency;

control means for determining a motion required to reduce the frequency error; and means for adjusting string tension responsive to the control means.

2. A system for tuning piano strings, comprising:

means for inducing a controlled vibration in the string at a chosen frequency close to its natural frequency;

means for sensing the phase shift of the response of the string;

means for determining the natural frequency error relative to a desired reference frequency, using information derived from the phase shift signal;

control means for determining a motion required to reduce the natural frequency error; and means for adjusting string tension responsive to the control means.

3. A system for tuning piano strings according to claim 2, wherein the signal processor compensates for signal delays in the sensor and the actuator.

4. A system for tuning piano strings according to claim 2 or 3, wherein means for inducing controlled vibration or means for sensing the controlled vibration is aligned with a string by a damper which is pivotally connected to a probe supporting said means.

5. A system for tuning piano strings according to claim 2, wherein the means for determining frequency error comprises a phase change detector measuring the phase between a reference frequency signal and a sensor signal for each cycle and comparing these measurements to measurements for previous cycles.

6. A system for tuning piano strings according to claim 2 or 3, wherein an indication or control signal is produced by a compensating circuit which causes the string to be tightened to a slightly higher frequency than the desired frequency to compensate for hysteresis.

7. A system for tuning piano strings according to claim 2 or 3, wherein the means for adjusting string tension comprises:

a socket which mates with a tuning pin;

a level arm which supplies torque to the socket; and anchoring means attached to an actuating device including a motor which provides force to the lever arm;

whereby the anchoring means when affixed to the piano frame accommodates the reaction torque of a tuning motion.

8. A probe for inducing a controlled vibration in a string of a musical instrument comprising an actuator, a sensor, aligned with the actuator, for sensing the inherent frequency or phase of the vibration, a clamp for frictionally engaging a string in the vicinity of the string being actuated by the probe, wherein the sensor comprises a transmit coil and a receive coil.

9. A probe as defined in claim 8, wherein the transmit coil is mounted at substantially a right angle to the receive coil.

10. A probe for inducing a controlled vibration in a string of a musical instrument comprising an actuator, a sensor, aligned with the actuator, for sensing the inherent frequency or phase of the vibration, a clamp for frictionally engaging a string in the vicinity of the string being actuated by the probe, and a damper pivotally mounted in substantial alignment with the clamp to maintain the probe in proper alignment with the actuated string and damp out vibration in an adjacent string.

11. A system for tuning piano strings according to claim 3, wherein the means for inducing a controlled vibration comprises an actuator transmitting controlled time-varying forces to the string at a frequency within a range wherein the string will give a resonant response.

* * * * *

UNITED STATES PATENT AND TRADEMARK OFFICE

CERTIFICATE OF CORRECTION

PATENT NO. : 5,065,660

DATED : November 19, 1991

INVENTOR(S) : Eric de Buda

It is certified that error appears in the above-indentified patent and that said Letters Patent is hereby corrected as shown below:

Col. 13, in claim 3, line 25, change "claim 2" to --claim 1--.

Col. 13, in claim 4, line 29, change "claim 2 or 3" to --claim 1 or 2--.

Col. 13, in claim 5, line 33, change "claim 2" to --claim 1--.

Col. 13, in claim 6, line 39, change "claim 2 or 3" to --claim 1 or 2--.

Col. 14, in claim 7, line 4, change "claim 2 or 3" to --claim 1 or 2--.

Col. 14, in claim 11, line 36, change "claim 3" to --claim 2--.

Signed and Sealed this

Eighteenth Day of April, 1995

Bruce Lehman

*Attest:*

BRUCE LEHMAN

*Commissioner of Patents and Trademarks*

*Attesting Officer*